US007735551B2

(12) United States Patent
Vozniak et al.

(10) Patent No.: US 7,735,551 B2
(45) Date of Patent: Jun. 15, 2010

(54) METHOD AND SYSTEM FOR FRACTURING SUBTERRANEAN FORMATIONS WITH A PROPPANT AND DRY GAS

(75) Inventors: Charles Vozniak, Calgary (CA); Thomas Vis, Red Deer County (CA); Michael Tulissi, Dewinton (CA)

(73) Assignee: Trican Well Service, Ltd., Calgary (CA)

( * ) Notice: Subject to any disclaimer, the term of this patent is extended or adjusted under 35 U.S.C. 154(b) by 518 days.

(21) Appl. No.: 11/317,123

(22) Filed: Dec. 23, 2005

(65) Prior Publication Data

US 2007/0000666 A1 Jan. 4, 2007

Related U.S. Application Data

(60) Provisional application No. 60/638,104, filed on Dec. 23, 2004.

(51) Int. Cl.
*E21B 43/267* (2006.01)

(52) U.S. Cl. ..... 166/177.5; 166/308.1; 166/307

(58) Field of Classification Search ..... 166/279, 166/307, 308.1, 177.5, 280
See application file for complete search history.

(56) References Cited

U.S. PATENT DOCUMENTS 3,603,398 A * 9/1971 Hutchison et al. ..... 166/305.1
4,512,405 A * 4/1985 Sweatman et al. ..... 166/278
4,716,932 A * 1/1988 Adams, Jr. ..... 137/565.29
5,000,264 A * 3/1991 Snider ..... 166/372

* cited by examiner

*Primary Examiner*—Jennifer H Gay
*Assistant Examiner*—Brad Harcourt
(74) *Attorney, Agent, or Firm*—Dunlap Codding, P.C.

(57) ABSTRACT

A method and system for stimulating underground formations is disclosed. The method includes injecting pressurized gas and low concentrations of proppant material at a rate and pressure sufficient to fracture the formation and allow for placement of the proppant in the fracture, followed by allowing the fracture to close on proppant to create a high-permeability flow channel without the use of liquid fracturing fluids or liquefied gases.

8 Claims, 8 Drawing Sheets

METHOD AND SYSTEM FOR FRACTURING SUBTERRANEAN FORMATIONS WITH A PROPPANT AND DRY GAS

CROSS REFERENCE TO RELATED APPLICATIONS

This application claims priority from U.S. Provisional Application Ser. No. 60/638,104, filed on Dec. 23, 2004, the contents of which are hereby incorporated herein by reference in their entirety.

FIELD OF THE INVENTION

This invention relates to the hydraulic fracturing of subterranean formations, and in particular to methods and systems for fracturing subterranean formations with dry gas.

BACKGROUND OF THE INVENTION

Hydraulically fracturing of subterranean formations to increase oil and gas production has become a routine operation in petroleum industry. In hydraulic fracturing, a fracturing fluid is injected through a wellbore into the formation at a pressure and flow rate sufficient to overcome the overburden stress and to initiate a fracture in the formation. The fracturing fluid may be a water-based liquid, an oil-based liquid, liquefied gas such as carbon dioxide, dry gases such as nitrogen, or combinations of liquefied and dry gases. It is most common to introduce a proppant into the fracturing fluid, whose function is to prevent the created fractures from closing back down upon themselves when the fracturing pressure is released. The proppant is suspended in the fracturing fluid and transported into a fracture. Proppants in conventional use include 20-40 mesh size sand, ceramics, and other materials that provide a high-permeability channel within the fracture to allow for greater flow of oil or gas from the formation to the wellbore. Production of petroleum can be enhanced significantly by the use of these techniques.

Since a primary function of a fracturing fluid is to act as a carrier for the introduced proppant, the fluids are commonly gelled to increase the viscosity of the fluid and its proppant carrying capacity, as well as to minimize leakoff to the formation, all of which assist in opening and propagating fractures. To allow for the formation to flow freely after the addition of the viscous fracturing fluid, chemicals known as breakers are added to the fracturing fluids to reduce the viscosity of the fluid after placement, and allow the fracturing fluid to be flowed back and out of the formation and the well.

The breaking of the fracturing fluid involves a complicated chemical reaction that may or may not be complete. The reaction itself may leave a residue that can plug the formation pore throats, or at very least reduce the effectiveness of the fracturing treatment. Many subterranean formations are susceptible to damage from the liquid or carrier phase itself, necessitating careful matching of fracturing fluids to the formation being fractured. Certain sandstones, for instance, may contain clays that will swell upon contact with water or other water-based fracturing fluids. This swelling decreases the ability of the formation fluids to flow to the wellbore through the induced fracture and therefore, inhibits or at very least reduces, the effectiveness of the fracturing treatment.

With specific reference to coalbeds, underground coal seams often contain a large volume of nature gas, and fracturing coal seams to enhance the gas production has become a popular and near-standard procedure in coalbed methane (CBM) production. Coal seams are very different from conventional underground formations such as sandstones or carbonates. Coal can be regarded as an organic rock containing a network of micro-fissures called cleats. The cleats provide the major pass ways for gas and water to flow to the wellbore. The cleats in coal, however, are very susceptible to damage caused by foreign fluids and particulates. Therefore, it is very important to use clean fluids in fracturing coal seams. High pressured nitrogen has been used in fracturing coal seams. Since it is gas and can be easily released from coal seams after the fracturing treatments, it causes very little damage to the formation.

SUMMARY OF THE INVENTION

In one aspect, the invention relates to a fracturing method including the steps of creating, a fracture or series of fractures in the formation, placing sand or proppant in the fractures followed by allowing, the fractures to close on the sand or proppant thereby providing a high-permeability channel from the formation to the wellbore without the introduction of liquid fracturing fluids, liquefied gases, or any combination of these fluids.

In another aspect, the invention relates to a method of fracturing a formation through a wellbore, comprises the steps of injecting a gas into the formation at a rate and pressure sufficiently to fracture the formation; adding a solid particulate to the gas whereby the solid particulate flows with the gas through the wellbore and into fractures in the formation; ceasing the addition of soled particulate while continuing the injection of gas to place the solid particulate into the fractures; and, ceasing of the injection of gas thereby allowing the fractures to close on the solid particulate.

In a further aspect, the invention relates to a system for introducing solid particulate into a wellbore using a dry gas stream comprising a dry gas source, a gas pump, tubulars, surface piping, a solid particulate delivery system.

In yet another aspect, the invention relates to a solid particulate delivery system for introducing particulate into a dry gas stream for fracturing comprising: a vessel for solid particulate and a venturi device associated with the vessel.

DETAILED DESCRIPTION OF THE INVENTION

Figure 1:
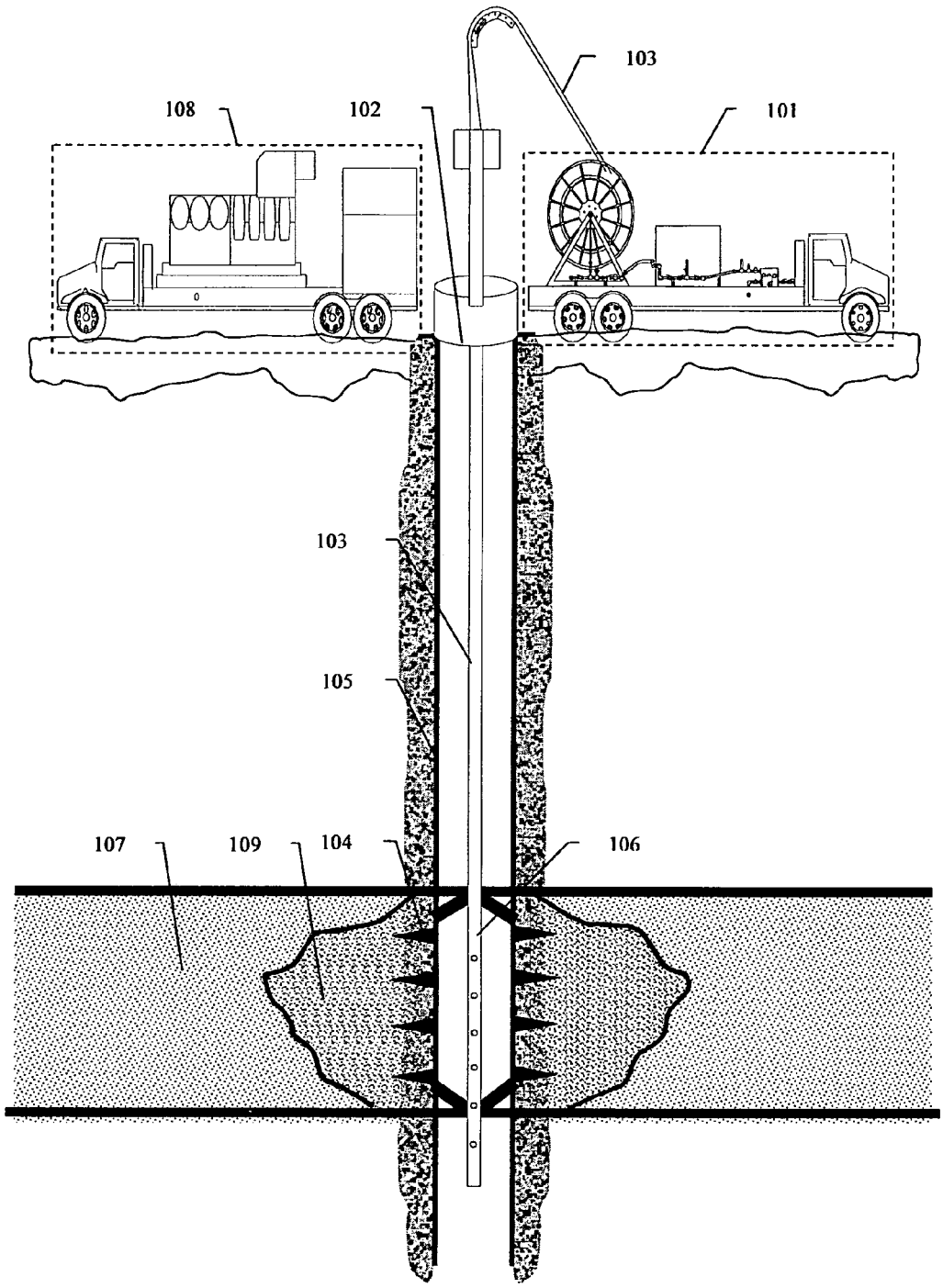
FIG. 1 is a plan view in partial-section of a wellbore completed with perforated casing in communication with a number of downhole formations, showing a prior art coiled tubing fracturing operation usable with the invention.

Although the method and system of the invention have application to many oil and gas bearing formations, including sandstones and carbonates, it has significant application to hydraulically fracturing of underground coal seams to increase the production of methane.

In one embodiment, the method of the invention includes injecting pressurized dry gas at a high rate (also referred to herein as "high-rate") and pressure, defined herein as a rate of flow and a pressure sufficient to create, open, and propagate fractures within a coalbed, a shale, a sandstone, a carbonate, or other formation and to introduce a proppant material into the fractures. Through the addition of concentrations of sand or other proppant materials to the gas stream, the proppant is placed within the fractures and prevents the fractures from closing, thus providing a highly porous and permeable flow path from the formation to the wellbore from which the gas and sand or proppant has been introduced. By placing the proppant into the fracture without the use of a liquid phase, any damage due to swelling of the pore throats of the formation, or other chemical reactions, is minimized.

In one embodiment, dry nitrogen gas is injected at a high rate and pressure into the formation using a cryogenic nitrogen pump. The dry gas is injected into the formation through the wellbore and associated tubulars, surface piping and valving. It is understood that the tubulars used to communicate the formation with the gas delivery system can be a coiled tubing configuration, or a jointed tubular configuration.

A downhole tool designed to allow pressure communication with the wellbore but isolate that pressure to the region of the tool is used. High-rate gas, such as nitrogen, is introduced to the tool through the tubulars from surface to initiate and propagate induced fractures into the formation.

Upon breakdown of the formation and the propagation of fractures, proppant or an abrasive agent (collectively, also referred to herein as a "solid particulate") in concentrations that may be considered low for conventional hydraulic fracturing is introduced into the gas and allowed to flow with the gas through the wellbore and into the induced fracture. These proppant or abrasive agent concentrations may vary widely depending on the rate of gas being pumped, the depth of the formation being fractured, and the formation itself. The method of the invention is not limited to a particular proppant or abrasive agent concentration.

Although other methods of introducing the proppant or abrasive agent are disclosed below, one embodiment includes the use of a pressure vessel connected to the piping transporting the gas from its source to the wellbore. The vessel is shaped to allow for gravity feed of the proppant or abrasive agent into the source piping, and may also incorporate an increase in flow piping diameter from a smaller diameter (e.g. 3 inch outer diameter) to a larger diameter (e.g. 4 inch outer diameter) thereby creating a venturi effect to draw the sand or proppant from the pressure vessel into the source piping.

After a pre-determined time or volume of proppant or abrasive agent has been introduced, introduction of said proppant or abrasive agent is discontinued at the surface but the pumping of the nitrogen gas is continued in order to place the proppant or abrasive agent in the fracture and to displace or flush the tubulars. After completion of the placement of the proppant or abrasive agent into the fractures, the nitrogen gas source is discontinued and the fractures allowed to close on the proppant or abrasive agent. Other dry gases besides nitrogen that are not in their liquefied state in the wellbore can also be used.

The method of the invention can be used to create fractures with the proppant used to keep the fracture open to create a flow channel for formation fluid production through a channel of higher permeability material. The method of the invention can also be used with an abrasive agent where the agent is used to erode or scour the face of the fracture thereby creating a channel or void space that is left open after closure of the fracture face. The choice between use of the method of the invention for propping or scouring, is primarily a function of the formation itself and the relative hardness of the proppant or abrasive agent and the formation.

In another embodiment of the invention, a proppant or abrasive agent is introduced into the gas stream as a discreet slurry or solid—liquid slug to carry the proppant or abrasive agent through tubulars and into the formation. The formation is put into communication with a source of high pressure and high rate dry gas, typically a cryogenic nitrogen pump, through the wellbore and associated tubulars and surface piping and valving. High-rate gas is introduced to the tubulars from surface so as to initiate and propagate induced fractures into the formation. A high concentration liquid—proppant or liquid—abrasive agent is premixed in a mixing means which is situated at the suction of a slurry pumping means.

Upon breakdown of the formation and the propagation of fractures, a slurry of liquid—proppant or liquid—abrasive agent is added to the gas and is allowed to flow with the gas through the tubulars and into the induced fracture. The concentration of the slurry may vary depending on rate of gas being pumped, depth of formation and formation itself. The sand, proppant concentration or surfactant/fluid type can be varied as needed.

The slurry may be added to the nitrogen gas stream using a positive displacement pump. This slurry may also be pumped through an inline densitometer into a manifold where it will be commingled with the gas stream. After pumping the desired treating volume or time, the slurry is shut off and the tubulars flushed with gas. This is not limited to over-flushing, but may also use under-flushing depending on the formation, the depth of formation, the proppant concentration and fluid type.

After completion of the placement or scouring of the proppant or abrasive agent into the fractures, the gas is discontinued and the fractures are allowed to close.

There are many ways to inject the liquid—proppant or liquid—abrasive agent into the gas stream; this method is just one means. The slurry also does not need to be premixed, but can also be mixed on the fly by direct addition of the proppant or abrasive agent stream.

Using the scouring method described above, a fracture or series of fractures is created in the formation, and the proppant or abrasive agent acts as an abrasive scouring agent or diverting agent within the created fractures. After the fractures have been allowed to close, the formation will close on itself with multiple high permeable channels from the formation to the well bore. This process will be achieved by adding very small concentrations of liquids into the formation.

Although this method of scouring may be seen as particularly beneficial to coalbed formations, it has application to sandstones, shales, carbonates, and other formations as well.

Referring initially to FIG. 1, the method according to one embodiment of the invention can be carried out by introducing proppant into a dry gas stream and into a wellbore using coiled tubing as the conveyance tubulars. A coiled tubing unit 101 is rigged onto the well 102 such that the coiled tubing 103 can be placed in communication with one or more open sets of perforations 104 in the casing 105 inside the well bore. The coiled tubing unit is typically equipped with coiled tubing of a single diameter ranging from 2⅞ inch to 3½ inch, for a wellbore cased with 4½ inch casing. Perforated casing is a standard wellbore completion well known to those skilled in the art of oil and gas production, such that no further details are required here.

A bottomhole assembly 106 is attached to the end of the coiled tubing 103. The bottomhole assembly 106 wherein the wellbore is positioned adjacent a set of perforations 104 so as to put the coiled tubing 103 in communication with the formation 107 by way of the bottomhole assembly 106. Dry gas, proppant and abrasive material can be pumped through a pumping and mixing means 108 and into the coiled tubing 103, contained within the immediate region of the perforations 104, to create a fracture 106 within the formation 107.

Figure 2:
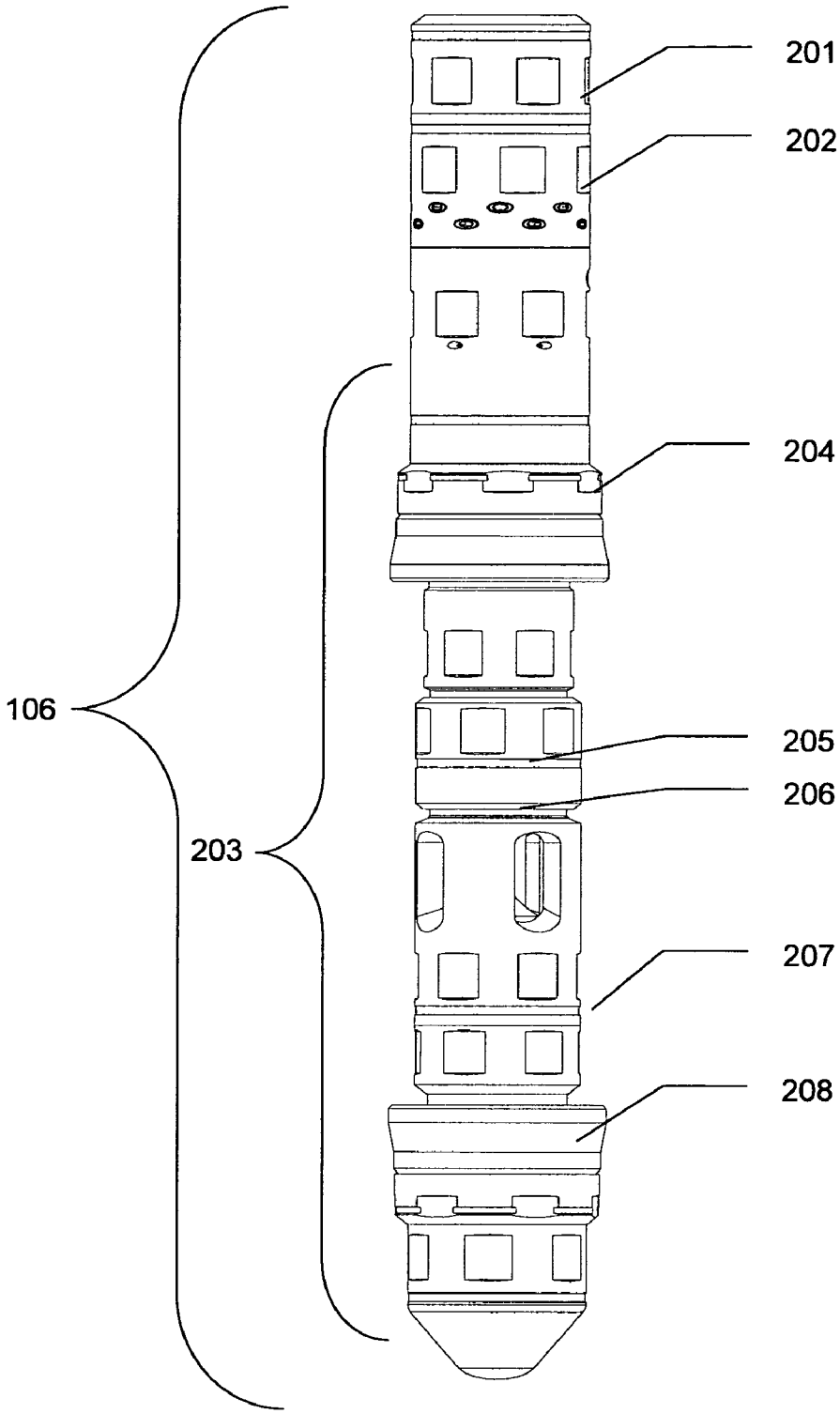
FIG. 2 is a detailed view of a prior art bottomhole assembly usable in coiled tubing fracturing operations according to the invention.

The bottomhole assembly 106 is shown in greater detail in FIG. 2, and includes a coiled tubing connector 201, a release mechanism 202, and a coiled tubing fracturing tool 203. The bottomhole assembly 106 also includes one or more upper pressure containing devices or cups 204, one or more flow ports 205 from which the pumped fluids exit the tubulars, a flow diverter 206 to deflect the flow and aid in exit of the flow from the tubulars, one or more bottom pressure containing devices or cups 207, and a bullnose bottom 208. Other suitable bottom hole devices commonly in use in coiled tubing fracturing operations can also be used.

Figure 3:
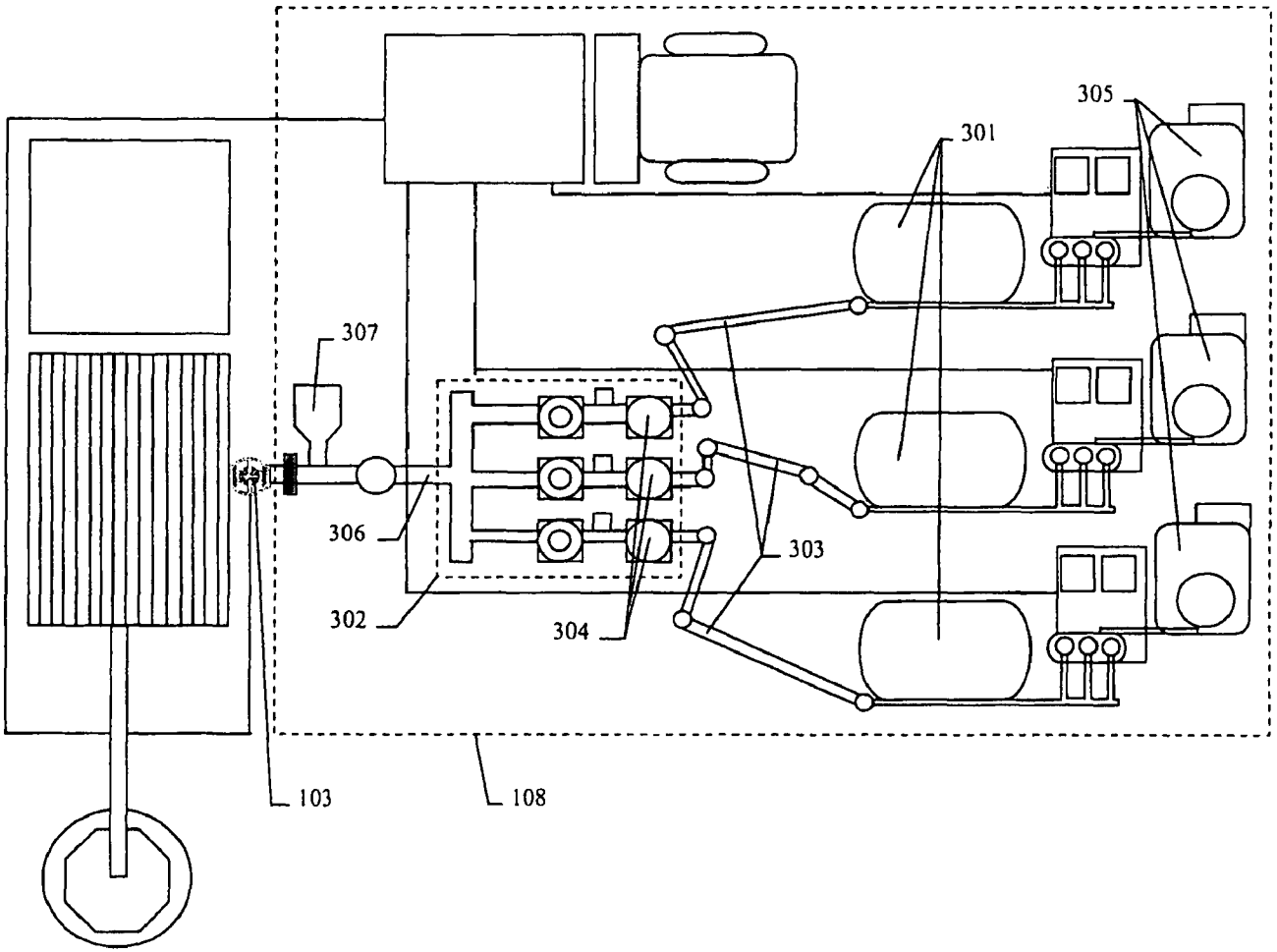
FIG. 3 is a plan view of an equipment system which can be used to conduct a gas—proppant fracturing operation according to the invention.

FIG. 3 shows the layout at the surface of an equipment delivery system according to one embodiment of the invention. The core-end of the coiled tubing 103 is attached to a gas and proppant delivery system 108. The gas and proppant delivery system 108 includes one or more nitrogen pumping units 301 that are connected together by an inlet manifold 302 such that each of the nitrogen pumping units 301 can supply nitrogen to the core-end of the coiled tubing 103, but are valved such that they can also be taken offline independently from the other units. Each nitrogen delivery line 303 includes a flow checkvalve 304 that prohibits flow from the well or manifold back to the nitrogen pumping units 301. Each nitrogen pumping unit may be connected to a nitrogen transport unit 305 to provide sufficient volumes of nitrogen to complete a fracturing operation.

The delivery system of FIG. 3 further includes multiple strings of treating iron 303 which connect the nitrogen pumping units 301 individually to an inlet gas manifold 302. A separate string of treating iron 306 connects the inlet gas manifold 302 to the proppant delivery apparatus 307.

Figure 4:
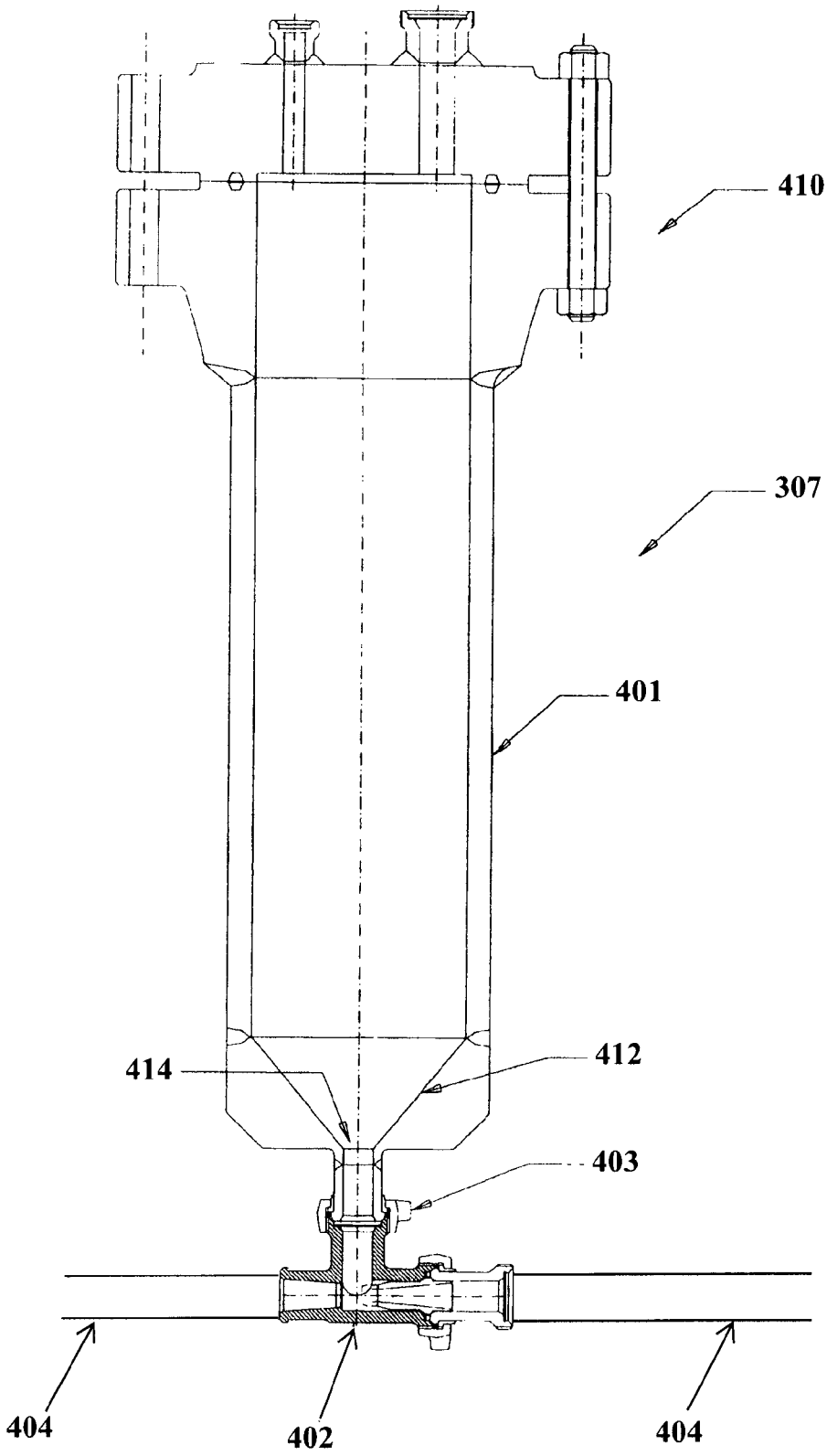
FIG. 4 is a cross-section of the proppant delivery system 307 shown in FIG. 3.

The proppant delivery system 307 is shown in greater detail in FIG. 4 and includes a pressurizable proppant storage vessel 401 and a proppant delivery nozzle indicated generally at 402. The vessel 401 may vary in size and pressure rating, and the delivery system 307 may be comprised of more than one vessel in series to allow for additional proppant supply without the need to replenish the vessel 401 during a fracturing operation. In one embodiment, the vessel 401 is rated to the same pressure as the treating iron 306, and has a flange indicated generally at 410 at the top for loading. The inner capacity of the vessel 401 is approximately 18 inches in diameter, and approximately 72 inches high providing a capacity for approximately 700 kilograms of standard 20/40 frac sand. The bottom 412 of the vessel 401 is sloped at 40 degrees to allow for vertical movement of proppant to the bottom and outlet 414 of the vessel 401. The bottom of the vessel is fitted with a control valve 403 that allows for both adjustment of the amount of proppant being released from the vessel, as well as to enable the source of proppant to be stopped altogether.

A venturi nozzle 402 is situated at the bottom of the vessel 401 and in communication with both the vessel 401 and the treating iron 404.

Figure 5:
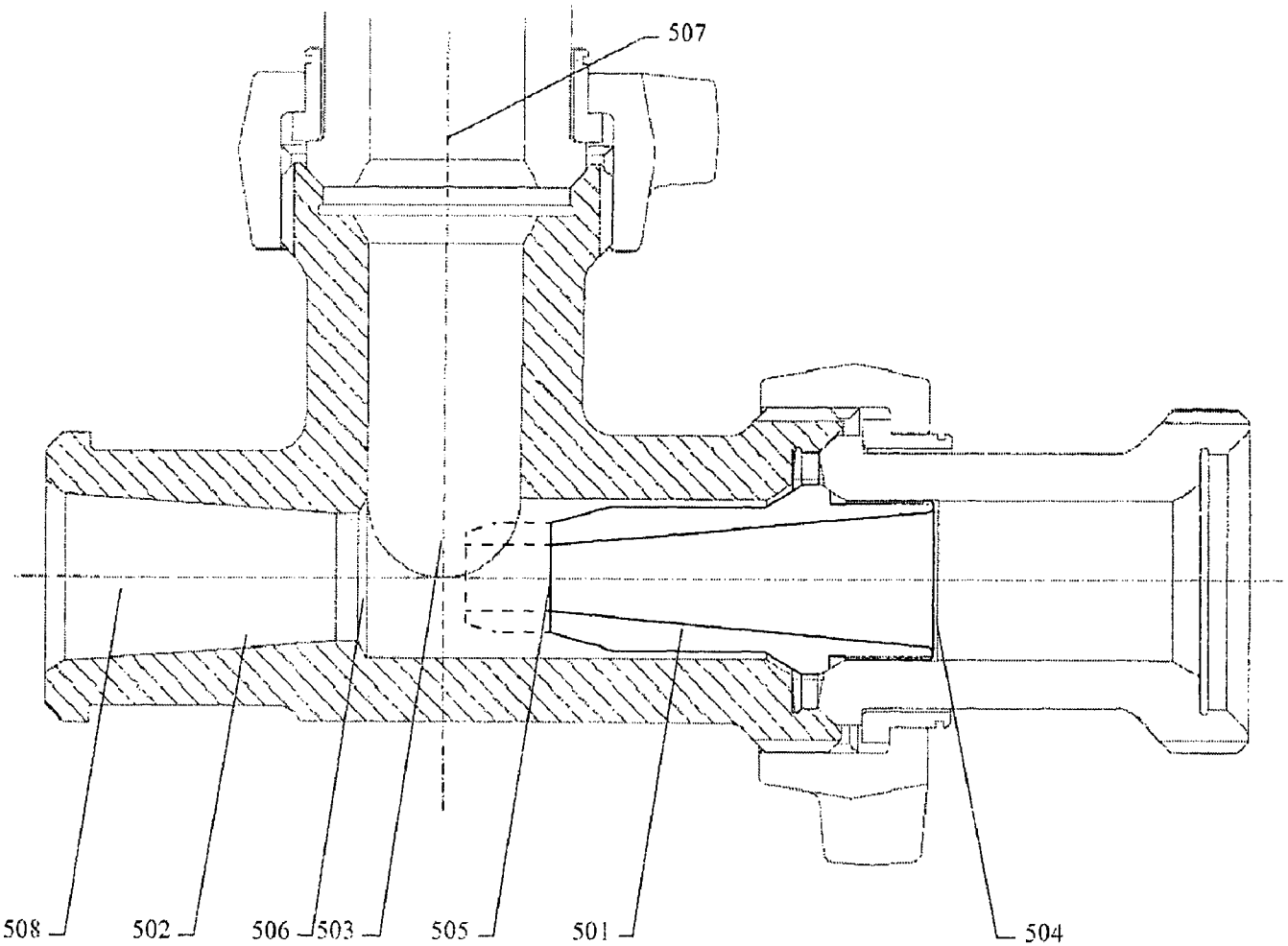
FIG. 5 is a cross-section of a venture nozzle of the proppant delivery system of FIG. 4.

The nozzle 402 is shown in detail in FIG. 5. The venturi nozzle 402 operates on known fluid dynamic principles taking advantage of the Bernoulli Effect. The nozzle 402 includes three key components, the nozzle 501, the diffuser 502 and the intake chamber 503.

In operation, pressurized gas enters the nozzle inlet 504 and is forced through and exits the nozzle 505 as a high velocity flow stream. The high velocity stream creates a partial vacuum in the intake chamber 503. This pressure drop allows proppant to flow from the intake 507 into the intake chamber 503.

Shear between the high velocity jet leaving the nozzle 505 and the proppant entering from the intake 507 causes the proppant to be mixed and entrained by the high velocity jet in the intake chamber 503. Some of the kinetic energy of the high velocity flow stream is transferred to the intake proppant as the two streams are mixed. This mixed flow stream then enters the diffuser 506 at a reduced pressure.

The flow then passes through the diverging taper of the diffuser 502 where the kinetic energy of the mixed flow stream is converted back into pressure. The mixed flow stream then exits the diffuser 507 and is discharged out of the nozzle exit 508. The discharge pressure is greater than the pressure at the intake 503 but lower than the pressure at the nozzle intake 504.

The nozzle is therefore, a venturi device that, under the flow of gas from the gas delivery system, creates a suction pressure at the bottom of the vessel 401 which assists in drawing proppant from the vessel 401 and into the treating iron 404. As with typical venturi devices, the effectiveness of the venturi effect and resulting suction pressure can be adjusted by adjusting the location of the end of the nozzle 501 relative to the outlet 414 of the vessel.

Figure 6:
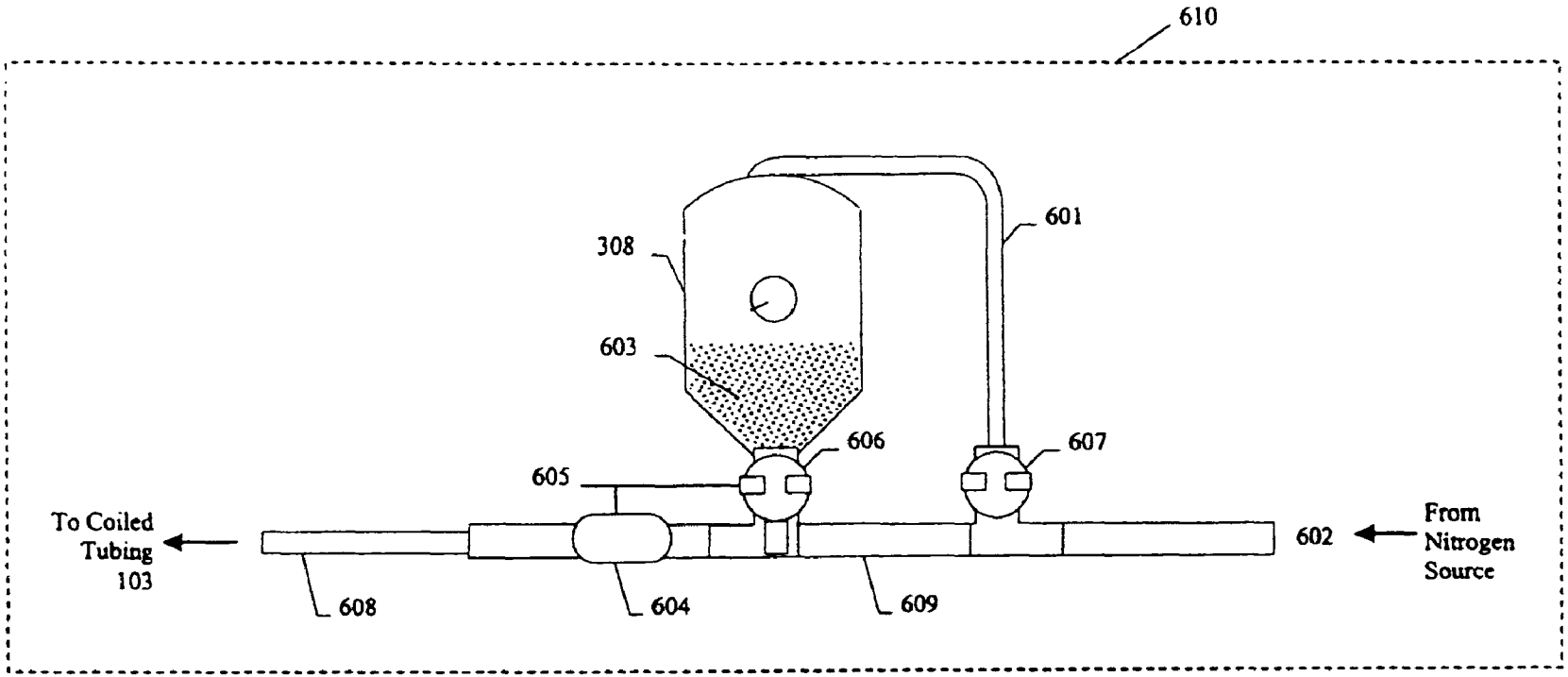
FIG. 6 illustrates another embodiment of a proppant delivery system according to the invention.

FIG. 6 shows a second embodiment of a proppant delivery system according to the invention indicated generally at 610 which can be used in place of the proppant delivery system 307. The proppant is introduced to the gas stream by connecting the top end of the proppant supply vessel 308 with a section of treating iron 601 in connection with the nitrogen supply line 602 from a nitrogen gas source (not shown) upstream of the proppant supply vessel 308. Nitrogen pressure and flow is controlled in the vessel 308 through opening or closing of the nitrogen supply valve 607. Proppant 603 is placed into the gas stream by gravity upon opening of the sand valve 606 at the bottom outlet of the vessel 308. Proppant 603 would preferentially exit the vessel 308 as the vessel 308 is pressurized from the upstream gas source 602.

A density gauge 604 is located downstream of the proppant supply vessel 308 that is used to measure the density of the gas/proppant mixture, and used to adjust the amount of proppant introduced relative to the gas stream to maintain the intended downhole densities. The density gauge 604 may be connected to the sand valve 606 through a controller mechanism 605 that automatically adjusts the valve to achieve the desired densities, or may simply provide a readout to allow for manual adjustment of the sand valve. In this embodiment the nitrogen supply line 602 is of 3 or 4 inch outer diameter, and the treating iron 601 downstream of the density gauge is of 3 or 4 inch diameter.

With the addition of proppant to the gas stream at the outlet of the supply vessel 308, a gas and proppant mixture is delivered to the core end of the coiled tubing 103 through a conventional control valve (not shown) and a rotating joint (not shown). The rotating joint allows for movement of the coiled tubing in and out of the wellbore while maintaining pressure integrity and control of the gas and proppant. Operations now take the form of a conventional coiled tubing live-well operation where pressurized fluids are delivered to a downhole formation.

Figure 8:
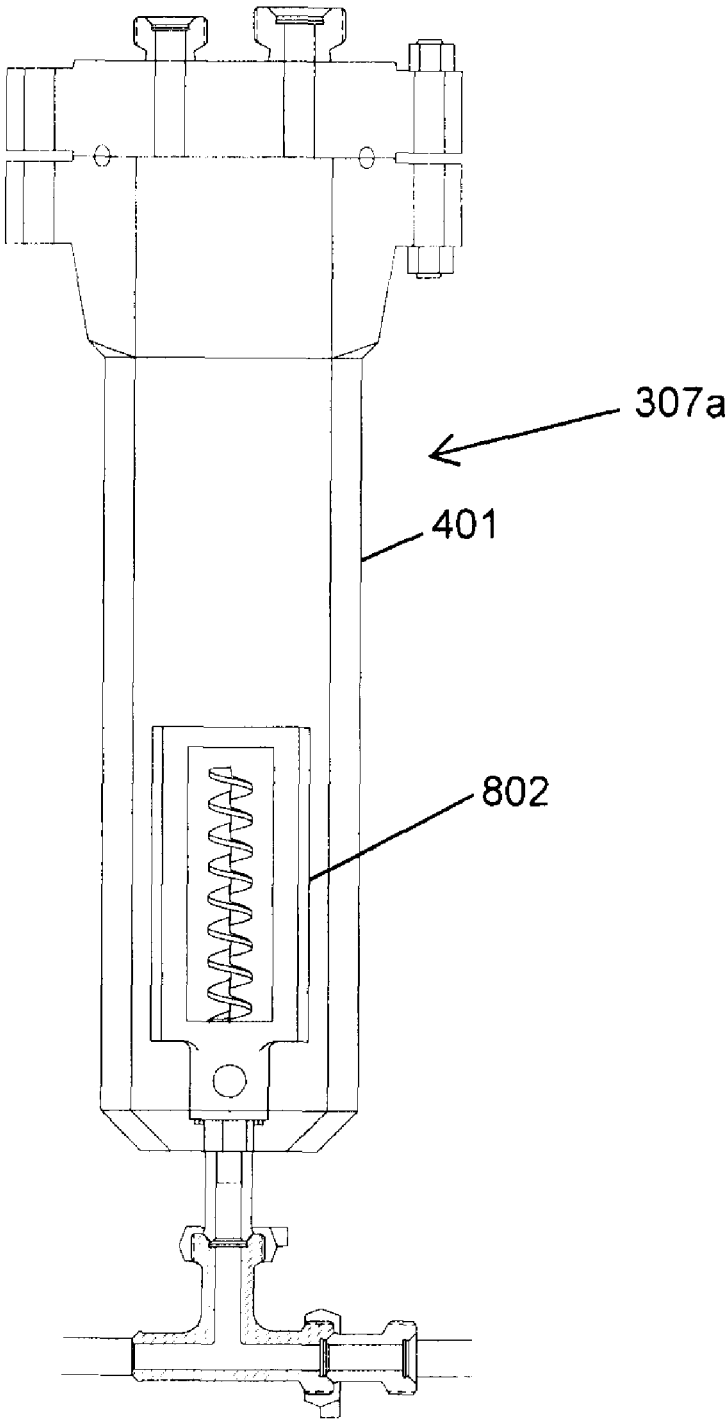
FIG. 8 is a cross-section of another proppant delivery system according to the invention.

FIG. 8 shows another embodiment of a proppant delivery system 307*a*. The proppant delivery system 307*a* includes a pressurizable proppant storage vessel 401*a* and a proppant delivery assembly 802. The vessel 401*a* is shown to be substantially similar to the vessel 401 described above in reference to FIG. 4. The proppant delivery assembly 802 includes a mechanical device which delivers particulate into the gas stream through a rotary or screw-type configuration, such as a screw pump or a progressive cavity pump.

Having described the delivery systems according to the invention, several methods of treating a downhole formation are discussed. In one embodiment, the coiled tubing, which has been fitted with a coiled tubing fracturing tool, is run into the well to a depth that places the coiled tubing fracturing tool across from a set of perforations in the casing which communicates the formation of interest with the inner casing space. Nitrogen is introduced to the delivery system with the proppant delivery system closed. The nitrogen delivery is at a rate and pressure sufficient to build sufficient pressure to initiate a fracture in the formation. This rate and pressure varies with the formation type, the formation depth, and the perforation geometry, however in common coalbed methane applications the conditions may require rates of about 1000 to about 2000 standard cubic metres per minute and downhole pressures of 35 Mpa or more. Nitrogen is pumped at the rates required to initiate a fracture in the formation which in Coalbed Methane applications is often in the range of one minute to five minutes. Upon fracture initiation the proppant delivery system is activated which allows proppant to be introduced to the delivery system. The concentration of proppant required will vary from formation to formation, but as gas is not an ideal carrying agent for solids, the concentrations will generally be in the range of 1000 kilograms per standard cubic metre at surface, resulting in a concentration at the formation in the range of 50 kilograms per standard cubic metre.

Formations fractured by this method are generally small intervals and the fractures generated by this technique are generally short and of narrow width. Accordingly, sand volumes pumped for each fracture would tend to be in the range of 0.1 to 0.5 tonnes, occasionally reaching or exceeding 1.0 tonnes.

The pumping schedules while fracturing will also vary depending on zone and strategic objective. In one embodiment, the rate required to fracture the formation may be in the range of 750 to 1000 standard cubic metre per minute. Upon fracturing of the formation, the rate at which the proppant is added to the gas stream and placed in the fractures is held constant at the same rate at which the fracture was initiated. After placement of the proppant in the fracture, the coiled tubing string is flushed with gas at the same rate as the fracture was generated, also pushing the proppant further into the fracture in the formation. After flushing of the coiled tubing, the coiled tubing and fracturing tools would be moved uphole to an adjacent zone and the procedure repeated at an adjacent perforated interval.

A variation to this method is to induce the fracture at the rates described above, but the rate then reduced to the range of 500 to 1000 standard cubic metres per minute to place the proppant material and flush the coiled tubing. Similarly, another variation would be to increase the proppant placement rate to the range of 1000 to 2000 standard cubic metres per minute per minute to place the proppant material and flush the coiled tubing.

In the above methods, all the proppant is placed in a single fracture in a continuous stage of placement. An alternate embodiment of this method includes placing several stages of proppant material in a single fracture by introducing proppant to the gas stream at the concentrations described above, flushing the coiled tubing, placing a second stage of proppant material at the concentrations described above, flushing the coiled tubing, and repeating this process several times before moving the coiled tubing to an adjacent set of perforations. This process, known as "stage fracturing" can also be combined with the technique of varying nitrogen rates between the steps of fracturing, placing proppant, and flushing. Rates can also be varied between stages, and between fractures. It is clear, then, that the combinations of rates and stages are many, and it would be tedious to attempt to specifically identify all possible combinations.

The above description relates to the addition of proppant directly into the gas stream. One alternative embodiment is to add the proppant to a small volume of liquid, used to create a proppant-liquid slug, then adding the proppant-liquid slug into the gas stream as a distinct entity rather than a continuous commingled stream. This allows the use of more conventional fracturing and pumping equipment, as the addition of a proppant to a viscosified liquid for fracturing is established technology, and the addition of a sand-ladened viscosified liquid to a gas stream, or vice-versa, is also established technology. In this embodiment, however, the intent of the liquid phase is as a means of adding the proppant to the gas stream to permit the use of standard fracturing equipment. The liquid phase used in this embodiment is typically of low viscosity and not designed to open and propagate fractures as would be the case with a conventional gelled or high-viscosity fracturing fluid.

Figure 7:
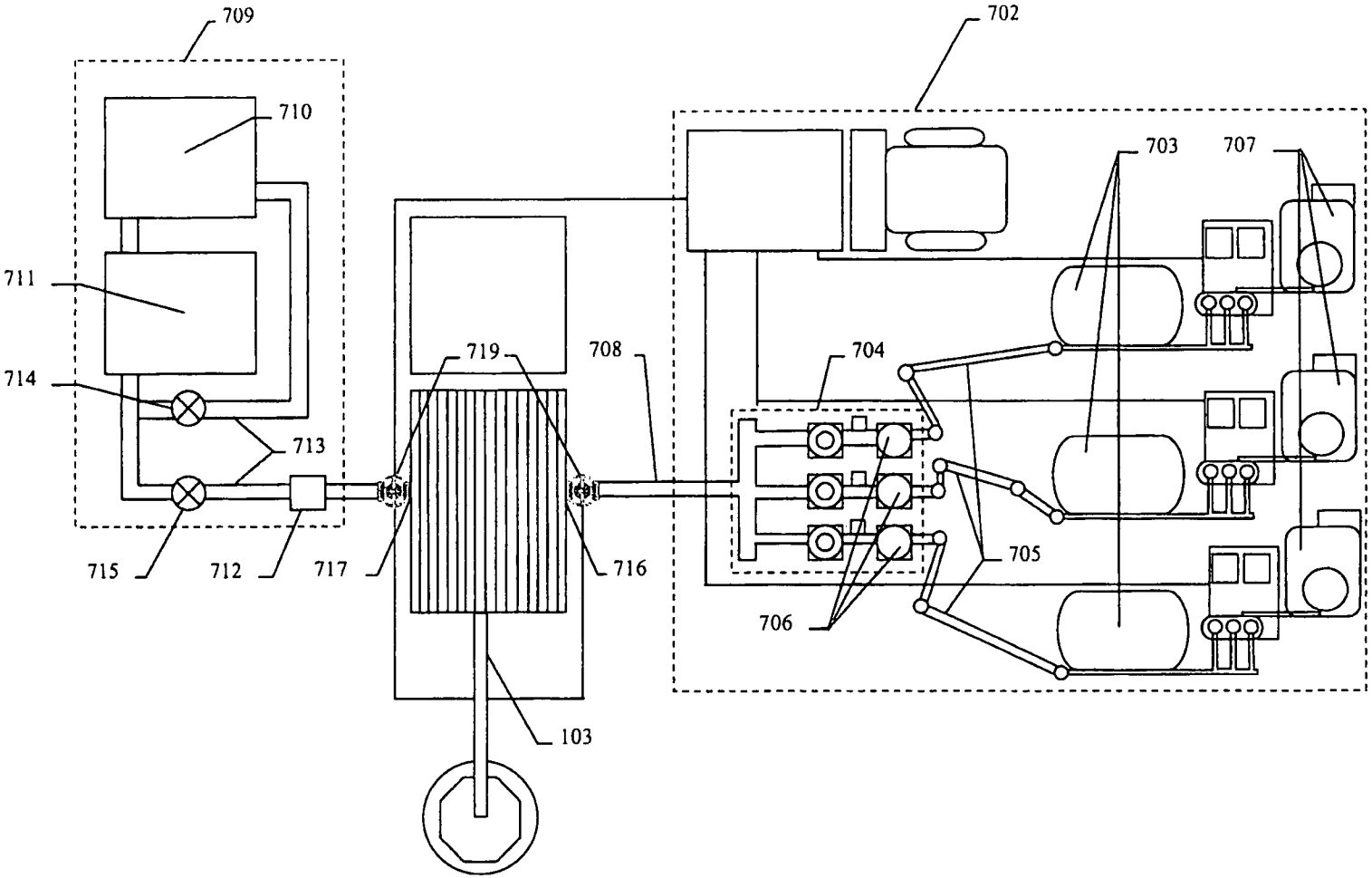
FIG. 7 is a plan view of another embodiment of an equipment system according to the invention.

This embodiment is shown in FIG. 7, and is generally similar to that of FIG. 3 but without the proppant delivery system and with the addition of liquid—proppant delivery system.

In this embodiment, the core-end of the coiled tubing 103 is attached to a gas delivery system 702. FIG. 7 shows the gas delivery system 702 includes one or more nitrogen pumping units 703 that are connected together by an inlet manifold 704 such that each of the nitrogen units 703 can supply nitrogen to the coiled tubing 103, but are valved such that they can also be taken offline independently from the other units 703. Each nitrogen delivery line 705 includes a flow checkvalve 706 that prohibits flow from the well or manifold back to the nitrogen pumping units 703. Each nitrogen pumping unit 703 may be connected to a nitrogen transport unit 707 to provide sufficient volumes of nitrogen to complete the operation.

The gas delivery system consists of multiple strings of treating iron 705 which connect the nitrogen pumping units 703 individually to an inlet gas manifold 704. A separate string of treating iron 708 connects the inlet gas manifold 704 to coiled tubing 103.

In this embodiment the proppant delivery system 709 includes a liquid pump means 710, a mixer or blender 711, a density measurement device 712, and associated treating iron or piping 713. The liquid pump 710 can be a standard fracturing pumping unit which receives low pressure liquids, with or without a proppant concentration, and provides high pressure liquid or mixture to the wellbore. The mixer or blender 711 can be a standard fracturing blending unit which receives liquid and mechanically adds and blends proppants to the liquid for delivery to the wellbore. The mixer or blender 711 means are connected to the pump 710 through the treating iron or piping 713 such that the liquid can be re-circulated through the mixer or blender 711 to allow for additional proppant to be mixed with the fluid to achieve the desired density, or delivered directly to the coiled tubing unit 103. This is determined by the strategic operation of a series of valves 714 and 715. To allow for recirculation, valve 715 is put in the closed position and valve 714 is put in the open position. To deliver the desired mixture to the coiled tubing unit 103, the valve 714 is closed and the valve 715 is open.

Referring again to FIG. 7, in operation the gas phase being delivered to the coiled tubing at a rotating joint 716 located on one side of the coiled tubing reel. It also shows the liquid—proppant phase being delivered to the coiled tubing at a second rotating joint 717 situated on the opposite side of the reel and combined with the gas phase at a T-junction inside the reel. An alternative method of combining the streams is to combine the streams upstream of the first rotating joint 716.

Density of the liquid—proppant mixture is measured at a density measurement device 712 which is located downstream of the fluid pump 710 and upstream of the rotating joint 717. Control valves 719 are located upstream of each rotating joint 717 to allow for isolation of either stream prior to entry into the coiled tubing 103.

With the addition of liquid—proppant to the gas stream, gas and liquid—proppant mixture is delivered to the core end of the coiled tubing unit. Operations now take the form of a conventional coiled tubing live-well operation where pressurized fluids are delivered to a downhole formation.

As with the previous embodiments, several variations of treating the downhole formation are discussed. In one embodiment, nitrogen is pumped at the rates required to initiate a fracture in the formation. Typical rates would be in the range of 750 standard cubic metres per minute for approximately one minute. A liquid phase is pumped at approximately 100 to 200 litres per minute to the mixing or blending means and mixed with a proppant concentration of approximately 1000 kilograms per cubic metre of liquid. This results in a slurry volume of approximately 5% slurry and a downhole concentration of approximately 50 kilograms per cubic metre. The coiled tubing is then flushed with approximately 1500 standard cubic metres per minute of nitrogen to ensure placement of the gas—proppant—liquid mixture in the formation of interest. The coiled tubing string is then re-situated against an adjacent formation and the process repeated.

Formations fractured by this method are generally small intervals and the fractures generated by this technique are generally short and of narrow width. Accordingly, sand volumes pumped for each fracture would tend to be in the range of 0.1 to 0.5 tonnes, occasionally reaching or exceeding 1.0 tonnes.

A variation to this method is to induce the fracture at the rates described above, but the rate then reduced to the range of 500 to 1000 standard cubic metres per minute to place the proppant material and flush the coiled tubing. Similarly, another variation would be to increase the proppant placement rate to the range of 1000 to 2000 standard cubic metres per minute to place the proppant material and flush the coiled tubing.

In the above embodiments of the method of the invention, all the proppant is placed in a single fracture in a continuous stage of placement. In another embodiment, several stages of proppant material are placed in a single fracture by introducing proppant to the gas stream at the concentrations described above, flushing the coiled tubing, placing a second stage of proppant material at the concentrations described above, flushing the coiled tubing, and repeating this process several times before moving the coiled tubing to an adjacent set of perforations. This process, known as "stage fracturing" can also be combined with the technique of varying nitrogen rates between the steps of fracturing, placing proppant, and flushing. Rates can also be varied between stages, and between fractures. The various combinations of rates and stages can be used as will be evident to those skilled in the art.

A variety of readily available proppants can be used in the embodiments described. For example, a fracturing sand of 20/40 mesh size with a density of 2600 kilograms per cubic metre can be used. Due to the limited capabilities of gas to carry solids, as compared to gelled or viscosified liquid fracturing fluids, it is desirable to consider the use of lower density or lighter weight proppants such as glass beads with a density in the range of 600 kilograms per cubic metre.

What is claimed is:

1. A method of fracturing a formation through a wellbore, comprising the steps of:

injecting a gas into the formation at a rate and pressure sufficient to fracture the formation;

adding a solid particulate to the gas whereby the solid particulate flows with the gas through the wellbore and into fractures in the formation;

ceasing the addition of solid particulate while continuing the injection of gas to place the solid particulate into the fractures; and ceasing of the injection of gas thereby allowing the fractures to close on the solid particulate; where the solid particulate is injected at a concentration ranging from 800 to 1200 kilograms of the solid particulate per cubic meter of dry gas at surface temperature and pressure, and 40 to 60 kilograms of the solid particulate per cubic meter of gas at downhole temperature and pressure.

2. A system for introducing solid particulate into a wellbore using a dry gas stream comprising a dry gas source, a gas pump, tubulars, surface piping, a solid particulate delivery system comprised of:

a solid particulate containment means; and a solid particulate introduction means, where the solid particulate containment means is located within the piping and downstream of the gas source and upstream of the tubulars, and where the solid particulate introduction means is a venturi device located on the bottom of the containment means whereby the particulate can be drawn into the dry gas stream by a gas venturi effect.

3. A system according to claim 2, where the particulate introduction means is a mechanical device which delivers particulate into the gas stream through a rotary or screw-type configuration.

4. A system of claim 3, where the mechanical device is a screw pump.

5. A system of claim 3, where the mechanical device is a progressive cavity pump.

6. A system according to claim 2, where the venturi device is a nozzle at the bottom of the particulate containment means.

7. A solid particulate delivery system for introducing particulate into a dry gas stream for fracturing comprising:

a vessel for solid particulate; and a venturi device associated with the vessel, where the venturi device is at the bottom of the vessel whereby the particulate can be drawn into the dry gas stream by a gas venturi effect.

8. A system according to claim 7, where the venturi device is a nozzle at the bottom of the vessel.

* * * * *